US005433360A

United States Patent [19]

Rock

[11] Patent Number: 5,433,360

[45] Date of Patent: Jul. 18, 1995

[54] WEAPON SLING

[76] Inventor: Thomas V. Rock, 519 Fox St., Denver, Colo. 80204

[21] Appl. No.: 183,327

[22] Filed: Apr. 28, 1994

[51] Int. Cl.[6] ..... A45F 3/14

[52] U.S. Cl. ..... 224/258; 224/913; 224/150

[58] Field of Search ..... 224/150, 202, 255, 257, 224/258, 913; 24/69 R, 69 ST, 69CT, 69 SB, 69 SK; D3/262; 42/85

[56] References Cited

U.S. PATENT DOCUMENTS

| | | | |
|---|---|---|---|
| 575,164 | 1/1897 | Perkins et al. | 224/913 |
| 1,092,203 | 4/1914 | Carter | 24/69 ST |
| 1,309,605 | 7/1919 | Badger | 42/85 |
| 2,446,197 | 8/1948 | Sloan | 224/913 |
| 2,889,095 | 6/1959 | Heidecke et al. | 224/257 |
| 3,441,185 | 4/1969 | Moomaw | 224/1 |
| 3,495,770 | 2/1970 | Steltmann, Jr. et al. | 224/1 |
| 4,099,306 | 7/1978 | Matthews et al. | 24/69 SB |
| 4,121,359 | 10/1978 | Bertetto et al. | 24/69 SK |
| 4,182,469 | 1/1980 | Bennett | 224/150 |
| 4,823,998 | 4/1989 | Johnson | 224/150 |

*Primary Examiner*—Henry J. Recla
*Assistant Examiner*—Charles R. Eloshway
*Attorney, Agent, or Firm*—Kyle W. Rost

[57] ABSTRACT

A weapon sling having a weapon release run and a weapon carrying run has a fastener with an L-shaped pivoting lever mounted near the stock end of weapon release ran. A rectangular lock ring is attached to the stock end of the weapon carrying run. The lock ring is engageable over the L-shaped lever, which can pivot over the ring to deposit the ring against an inclined surface of the fastener that retains the ring against accidental loss under tension applied to the sling.

20 Claims, 1 Drawing Sheet

WEAPON SLING

TECHNICAL FIELD

The invention generally relates to package and article carriers, carried by an animate bearer, especially to a sling attached to a rifle or shotgun. A sling is provided with a buckle that is both highly resistant to accidental opening, yet is easily opened by intentional action.

BACKGROUND ART

A sling often is used with an elongate weapon such as a rifle or shotgun. The purposes for the sling include not only carrying the weapon, often in a choice of multiple positions, but also steadying the weapon during firing. In order to serve multiple purposes and allow the weapon to be carried and fired in multiple positions, the sling has evolved from a single strap into a sophisticated system of various straps, loops, snaps, rings, friction slides and buckles. An important feature of a sling is the ease and speed with which it can be convened from one configuration to another. For this reason, the snaps, rings, slides, and buckles are intended to be operated easily and quickly. Generally, each sling serves these functions: (1) weapon carrying, by providing a basic shoulder strap connected between the butt and stock of the weapon; (2) strap length adjustment, varying the effective length of the shoulder strap to fit the shooter, such as by buckles or by looped strap and friction slide; (3) weapon release and steadying, allowing rapid movement to firing position, generally involving release of two portions of the sling so that the gun stock gains increased freedom of movement. The third function is critical to users, whether military, police, or sportsman, since aiming and shooting often require fast response. As described below, the art has employed a release mechanism such as a hook, spring tongue clip, or snap to free a slidable cord or steadying strap connected to the weapon stock, allowing increased movement of the weapon stock while causing the sling to cinch around the shooter's body. The shooter gains a bracing effect from the cinching and then can steady the weapon from the taunt steadying strap. However, the shooter wants the release to be quick, silent, positive, reliable, and complete. Any delay or fault in this function is certain to be unacceptable.

A sling has distinct front and rear ends, determined by the fit on the weapon. Typically the weapon carries a swivel on its butt and another swivel on its stock, and the sling attaches its mar end to the butt swivel and its front end to the stock swivel. This orientation is important because the sling will carry its release mechanism near the front or stock end for ready access.

The basic carrying function is met by a single run of flat strap attached between the butt swivel and stock swivel. In primitive form, such a strap can become length-adjustable by the addition of an intermediate buckle, coupled with a suitable excess length of strap. However, it is much more common to provide a substantial extra length of strap, to loop the first run of strap through the butt swivel, and to bring back the excess as a second run in parallel with the first run. The terminal end of this second run can be fixed to the center bar of a friction slide, which is slidably carried on the first run. Thus, the strap becomes length adjustable by moving the friction slide along the first run, with the second run being shortened to supply any needed additional length or lengthened to take in any excess from the first run. The structural modifications for converting such a length-adjustable sling to a stock-releasing sling with a steadying strap can best be described by reference to the following patents from the prior art.

U.S. Pat. No. 3,441,185 to Moomaw discloses a one-piece, three-run strap sling that is adaptable to various weapon carrying positions. One end of the strap is fixedly attached to the center bar of a three-bar friction slide. From this attachment point, the strap defines a first, length adjusting run extending forward toward the weapon stock until it loops back around the center bar of a three-bar twin loop, which also has respective upper and lower bars defining an upper and a lower loop. From the twin loop, the strap forms a second, carrying run extending rearwardly, on weapon-facing side of the first run, slidably weaving through the friction slide, and continuing rearwardly through the butt swivel. From the butt swivel, the strap again extends forwardly as a third, weapon steadying run on the face of the sling opposite from the weapon, passes through the lower loop of the twin loop, weaves through a hook buckle, passes around the stock swivel, and is woven back into the hook buckle, where the second end of the strap is secured. The hook portion of the hook buckle is engageable with and disengageable from the upper bar of the twin loop. This arrangement permits sling length to be adjusted by moving the friction slide with respect to the second run, similar to the general description given above. The shooter can carry the weapon by passing the sling over his body with the first and second runs behind him and the third run in front. Then, by disengaging the hook buckle from the twin loop, the shooter quickly and easily can pull the third, weapon steadying run through the lower loop of the twin loop, providing needed freedom to raise the stock to firing position. Thus, the weapon can be moved quickly and easily from carrying position to shooting position by merely unhooking the twin loop from an open, fixed hook.

A two-run strap sling is shown in U.S. Pat. No. 3,495,770 to Seltmann, Jr., et al. The first, weapon carrying run of this sling is multi-segmented and is formed of a long, flat first strap portion attached by a length adjustable, looped end to a butt swivel. This first run extends forwardly almost to the stock and serves as the basic carrier. Just before the stock, this flat, weapon carrying strap terminates in a slide ting. A separate short, flat strap segment is attached to the stock swivel in another length adjustable loop. The short segment is engageable to and disengageable from the slide ring of the longer segment by use of a spring tongue hook. The second run is a weapon steadying slide cord that extends from the short strap, through the slide ting, and rearwardly to the butt end loop of the flat strap. In use, the first run of sling is worn behind the shooter's body and the slide cord is worn in front of the shooter's body. When the spring tongue hook is released from the slide ting, the slide cord easily moves through the slide ring, and the weapon is moved quickly and easily to firing position. The Seltmann patent also provides for length adjustment of the long and short flat straps by buckles in the loops at the butt and stock ends.

U.S. Pat. No. 4,1822,469 to Bennett discloses another two-run sling. The first run, a weapon steadying strap, is attached to the stock swivel and extends rearwardly, looping through the butt swivel. The strap continues as a second, weapon carrying run that extends forwardly from the loop and terminates in a slide ring. The first run passes through this slide ring, which can move easily over the length of the first run. A short snap strap segment is connected to the stock swivel and carries a snap fastener, while the stock end of the second run carries the mating snap rivet just rearwardly of the slide ring. The snap is engaged in order to fasten the slide ring near the stock swivel, such as when the weapon is in carrying position. When the snap is disengaged, the first run is pulled easily through the slide ring, allowing the stock to be moved easily to firing position.

The Bennett patent provides an optional length adjustment for the sling by breaking the second run, allowing excess strap length for various amounts of overlap at the break, and providing multi-position hooks that mate with selected holes in the second run at the desired amount of overlap. A commercial product known by the trademark Action Sling, sold by Slings 'N Things, of P.O. Box 4053, Omaha, Nebr. 68104, is similar to the product described in the Bennett patent but substitutes a length adjuster of the friction slide type. The stock end of the second run is broken on the butt side of the rivet fastener, and the second run loops back under itself, forming a third, length adjusting run that extends to a terminating attachment to the center bar of a three bar friction slide, which is slidably carried by the second run. The loop between the second and third runs carries a fastening ring, which also is attached to the stock end segment of the second run near the snap rivet. Thus, the second run becomes length adjustable by movement the friction slide. The snap fastener remains the means for releasing the second run and slide ring when the weapon is to be raised to firing position, as previously described. The problems of the prior art are in the function of the release mechanism, which has been unreliable or overly difficult to operate. For example, the open hook of the Moomaw patent could become disconnected inadvertently, if the sling were in a slack condition. The spring tongue fastener of the Seltmann patent requires substantial effort to unfasten and does not allow quick release. The snap fastener of the Bennett patent can be separated inadvertently under tension or by accidentally brushing the snap strap segment. Also, a snap creates noise during opening, which can be undesirable in some uses.

It would be desirable to have a sling with a release mechanism that is secure under tension. Similarly, it would be desirable to have a releasable fastener that is difficult to actuate accidentally. A desirable additional feature would be for such a releasable fastener to be quiet in use.

To achieve the foregoing and other objects and in accordance with the purpose of the present invention, as embodied and broadly described herein, the weapon sling and release mechanism of this invention may comprise the following.

DISCLOSURE OF INVENTION

Against the described background, it is therefore a general object of the invention to provide an improved weapon sling in which the weapon release mechanism is both secure against accidental release and reliable for intentional release.

Another object is to provide a weapon sling having an extremely quiet weapon release mechanism.

A further object is to provide a weapon sling that may be constructed efficiently, from a single strap, to save the weight and expense of buckles and other joiners.

Additional objects, advantages and novel features of the invention shall be set forth in part in the description that follows, and in part will become apparent to those skilled in the art upon examination of the following or may be learned by the practice of the invention. The object and the advantages of the invention may be realized and attained by means of the instrumentalities and in combinations particularly pointed out in the appended claims.

According to the invention, an improved weapon sling of the type having a butt end and an opposite stock end for attachment to the respective butt and stock of an elongate weapon is constructed of at least first and second longitudinally extending strap portions. The first strap portion has a first end near the stock end of the sling and extends between the first end and the butt end of the sling. The second strap portion extends between the butt end of the sling and the stock end of the sling. The improvement relates to a fastening mechanism carried by the second strap portion near the stock end of the sling for selectively engaging and disengaging the first end of the first strap portion. The fastening mechanism includes both a camming member and a mounting member for pivotally carrying the camming member. In addition, the fastening mechanism includes an engaging device carried by the first end of the first strap portion for engaging with and disengaging from the fastening member. The camming member includes first and second arms joined at an acute angle, pivotally carried on the mounting means for selective movement between an open position, in which the first arm is between the engaging means and the first strap portion, and the second arm is between the engaging device and the stock end of the sling; and a closed position in which the engaging device is between the first arm and the first strap portion, and the second arm is between the engaging device and the butt end of the sling.

The accompanying drawings, which are incorporated in and form a part of the specification illustrate preferred embodiments of the present invention, and together with the description, serve to explain the principles of the invention. In the drawings:

BEST MODE FOR CARRYING OUT THE INVENTION

Figure 1:
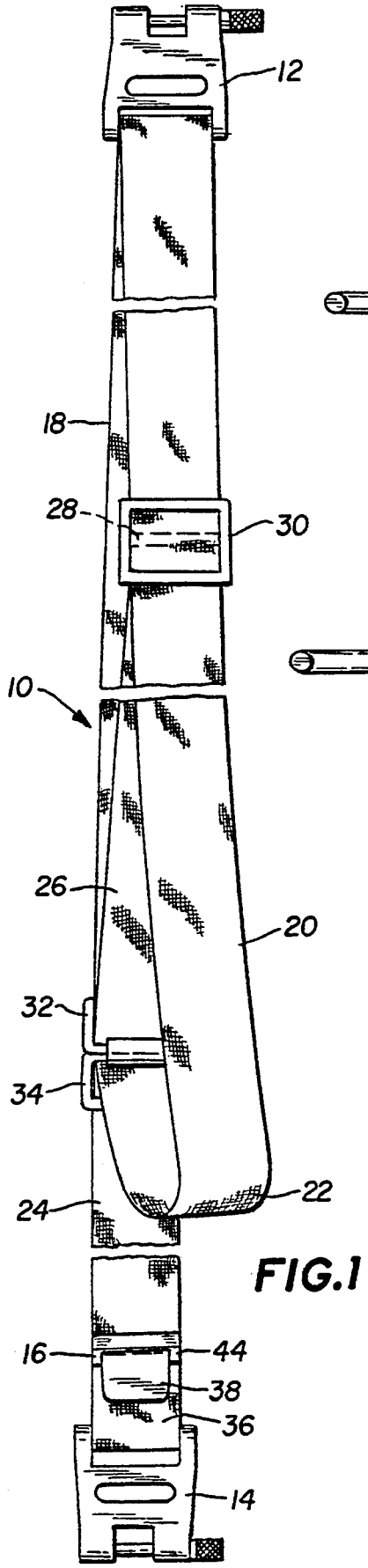
FIG. 1 is a plan view of the weapon sling, broken to condense its length.

With reference to FIG. 1, the present invention is a weapon sling 10 of the type that has a butt end and a stock end, for attachment to the respective butt end and stock end of an elongate weapon such as a rifle or shotgun. The butt end typically carries a butt swivel 12 and the stock end carries a stock swivel 14 for mounting the sling to the weapon. For convenience of reference, the longitudinal ends of the sling will be referred to as the respective butt end and stock end, as though the sling were longitudinally disposed as shown in FIG. 1 with the butt end at the top of the figure and the stock end at the bottom. The sling employs a reliable, quiet, secure fastener 16 as its releasable fastening means for allowing increased movement to the weapon stock. Further, the overall structure of the sling 10 permits the sling to be lighter in weight than an equivalent sling of prior art construction. These advantages are enabled, in part, by the construction and operation of a novel fastener 16.

The strap 18 of sling 10 can be of one-piece or multiple piece construction, looped as necessary to form at least first and second longitudinally extending strap portions. The first strap portion 20, a weapon carrying run, has a first end or end loop 22 near the stock end of the sling and extends between this first end and the butt end of the sling, where it engages butt swivel 12, such as by looping through this swivel. The second strap portion 24, a stock releasing and weapon steadying run, extends between the butt swivel 12 at butt end of the sling and the stock end of the sling, where it engages stock swivel 14, such as by looping through this swivel. It is preferred that the first and second strap portions comprise a single, continuous strap, defining a loop at the butt end of the sling and carrying the butt mounting swivel 12 on the butt end loop. If used, a third strap portion 26, which is a length adjusting run, has a free end attached to the center bar 28 of a three bar friction slide 30, carried on first strap portion 20 for longitudinal, slidable movement. The length adjusting run 26 extends between the friction slide and the first end 22 of strap portion 20. It is preferred that the first and third strap portions are a single, continuous strap, defining a length adjusting loop at the first end of the first strap. As the strap doubles back upon itself at the junction of straps 20 and 26, it defines the first end or end loop 22 of strap 20, which is a length adjusting loop. This loop passes through and carries a slide ring 32 and a lock ring 34. In addition, the second strap portion 24 passes through slide ring 32. Of the three strap portions 20, 24, and 26, strap portion 24 is closest to the weapon, strap portion 26 is in the center, and strap portion 20 is the outer strap of the sling.

Figure 2:
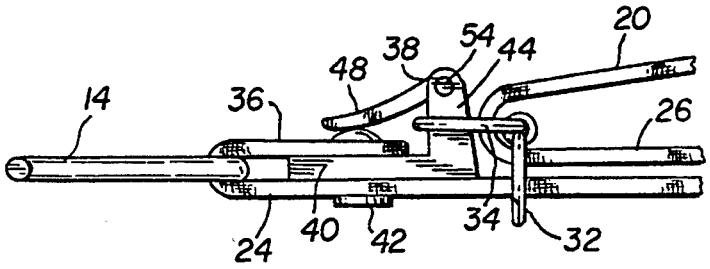
FIG. 2 is an enlarged side view of the stock end of the sling, showing the release mechanism in closed position.
Figure 3:
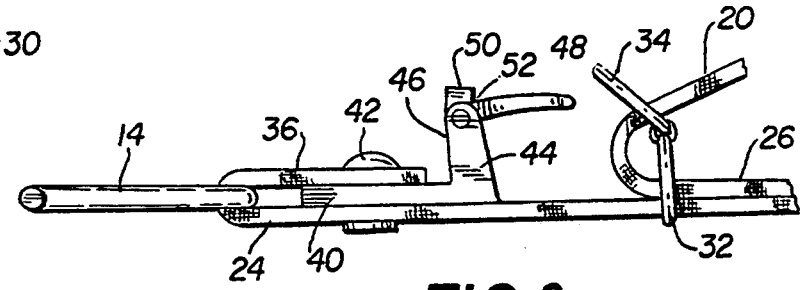
FIG. 3 is a view similar to FIG. 2, showing the release mechanism in open position and the fastening ring withdrawn from it.

Referring to FIGS. 2 and 3, strap portion 24 is joined to the stock swivel 14 by a terminal loop, formed by a continuing segment 36 of strap portion 24, carried at the stock end of strap portion 24. At stock swivel 14, segment 36 is folded over strap portion 24, toward the butt end of the sling, overlying the stock end of strap portion 24. Together with the stock end of strap portion 24, segment 36 defines a terminal loop for attaching the strap to the swivel mount 14.

Strap portion 24 carries the fastener 16 or an equivalent fastening means near the stock end of the sling for selectively engaging and disengaging an engaging means carried by the first end of the first strap portion. A suitable engaging means may be a loop at the first end 22 of strap portion 20, a latch, a rectangular ring, a hook or other mechanism capable of engaging the fastening means. The preferred engaging means is a lock ring 34 of sufficient length and width to be engaged with fastener 16. Typically, the lock ring is slightly wider than strap 18. The ring is preferred to be rectangular so that its stock end and butt end form substantially straight spans for contact with the fastener and end loop 22.

The fastening means includes both a camming member 38 and a mounting means for pivotally carrying the camming member. In addition, the fastening means is preferred to include a base 40 of about the same width as strap portion 24, as an aid to attaching the fastening means to the straps. The fastener base 40 has generally planar upper and lower faces, lying generally parallel to the broad faces of strap portion 24. According to the view of FIGS. 2 and 3, the lower face of the base 40 overlies strap portion 24, and the continuing strap segment 36 overlies a part of the upper face of the base at the stock end of the base. An attaching means is preferred to affix the base to both strap portions 24 and 36, respectively on the bottom and top faces of the fastener base in the view of FIGS. 2 and 3. A suitable, preferred attaching means for affixing the strap to the base is one or more post screws 42 passing through both layers of strap and the central base. Other attaching means may include stitching, adhesive bonding, and other equivalents. When attached between the continuing segment 36 and strap portion 24, the base closes the loop through stock swivel 14. By sharing this loop with stock swivel 14, the fastener base tends to remain longitudinally aligned with the stock swivel when other portions of the sling are placed in tension, preventing accidental opening of the fastener.

The mounting means, which is preferred to be carried on base 40 of fastener 16, is a pair of laterally spaced apart, generally upstanding hinge mounts 44. One hinge mount 44 is near each of the opposite lateral edges of strap 24. However, the preferred width of the fastener 16, including the hinge mounts, is about the same as strap 24 so that lock ring 34 or the like can be engaged and disengaged over the fastener without catching on unnecessary edges or laterally protruding corners. Thus, the inclusive outside width of the fastener at hinge mounts 44 is similar to the width of snap portion 24. The stock-end face 46 of these mounts 44 defines a contact surface for receiving the lock ring 34 and is upstanding with respect to base 40. More specifically, this contact surface 46 is inclined toward the planar base by an inside angle slightly less than a right angle. For example, this face may be disposed at 75° to the plane of the base. As a result of such an angle, the contact surface will perform when the sling is in tension by tending to retain an engaging means, such as lock ring 34, placed over it against. Under such longitudinal tension, the contact surface will guide the lock ring against the intersection of the contact surface and the upper face of the base.

The camming member 38 is pivotally carried by the mounting means and has two arms in generally L-shaped configuration. The first arm is a lever arm 48 and the second arm is a tongue 50. These arms meet with an inside angle of less than 180°. For example, the angle may be an acute inside angle of slightly less than 90° and is preferred to be about 75°, so that a V-shaped intersection 52 is formed at the meeting of the arms. The camming member is moveable on the hinge mounts between at least two positions. One position, which may be termed the open position, allows the engaging means or lock ring 34 to be attached to or detached from fastener 16. In open position, generally shown in FIG. 3, the first arm 48 is between the lock ring 34 and the strap portion 24, and the second arm 50 is between the lock ring 34 and the stock end of the sling. In a second position, which may be termed the closed position, the engaging means is secured by fastener 16. In closed position, shown in FIG. 2, lock ring 34 is between the first arm 48 and the strap portion 24, and the second arm 50 is between the lock ring and the butt end of the sling. The second arm 50 is substantially contained between the hinge mounts 44 when the fastener 16 is in closed position. Due to the inside angle between lever arm 48 and tongue 50, when the face of the tongue is approximately even with the contact face of the hinge mounts, such as in the closed position of FIG. 2, lever arm 48 is inclined toward base 40. In practice, the lever arm rests against the post screws 42 when in this closed position. If the lever arm 48 should become accidently raised, tongue 50 is brought in front of contact surface 46, where any subsequent tension of the sling will apply lock ring 34 against tongue 50 to re-close the lever arm.

In closed position, tongue 50 serves to lift and guide the lock ring out of engagement with the hinge mounts and camming member. In order to perform this function, the tongue has positive engagement with the lock ring whenever it moves from closed to open position. The mounting means pivotally engages the camming member 38 along a hinge 54 generally defining a pivot axis at a predetermined distance from the base 40. The tongue 50 is of a length, measured from the pivot axis, less than the predetermined distance of the pivot axis from the base. However, the tongue is shorter than the predetermined distance of the pivot axis from the base by less than the thickness of the lock ring. Therefore, the lock ring cannot slip under the tongue when the camming member is moving from closed to open position. In addition, the angle between the lever arm 48 and tongue 50 tends to move the lock ring into the V-shaped intersection 52, preventing the ring 34 from sliding off the tongue during such opening movement. Further, the lever arm 48 is of a length greater than tongue 50 so as to have a mechanical advantage in opening the fastener.

As explained above, the inclined angle of contact face 46 and the V-shaped intersection 52 of arms 48 and 50 each provide security against accidental loss of lock ring 34 from fastener 16 when the strap is in tension. Since the functions of these two parts are the same, they can operate either independently or in cooperation. Generally, the contact face 46 serves as the primary means of retaining the lock ring in fastener 16. However, the closed lever arm 48 cooperates by preventing loss of lock ring when the sling is not in tension, and the tongue 50 cooperates by preventing the lever arm from opening by accident. Therefore, the camming means acts not only in cooperation with the hinge mounts but in a redundant lock ring retaining role, as well.

Figure 4:
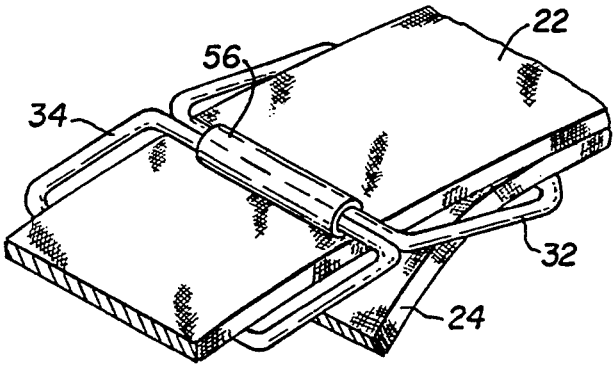
FIG. 4 is an enlarged detail view of the hinged fastening ring and slide ring.

As previously noted, the length adjusting loop 22 between the first and second runs of the strap 18 holds the two rings 32 and 34. Both rings are preferred to be rectangular. The slide ring 32 receives both the length adjusting loop 22 and the weapon release run 24, while the lock ring 34 receives only the length adjusting loop. The rings each have one span inside the length adjusting loop, as shown in FIG. 4. These spans are joined by a common hinge means, which is preferred to be formed of a tubular member 56 that receives a straight span of each ring. While the preferred hinge member 56 is a plastic tube, the hinge means may be another simple, light weight joiner, as there is substantially no stress placed upon it. The hinge means joins the slide ring 32 to the engaging means for maintaining the first end 22 of the first strap portion 20 in approximate alignment with the base 40 when the engaging means is engaged with the fastening means.

In operation, when the sling is to be locked in weapon carrying configuration, the operation of the fastener 16 requires that the lever arm 48 be folded back toward the butt end of the sling, as shown in FIG. 3. Length adjusting loop 22 is brought close to the fastener 16, allowing locking ring 34 to be placed in the junction 52 of lever arm 48 and tongue 50. Arm 48 is flipped toward the stock end of the sling, into closed position, which automatically brings lock ring 34 over the hinge mounts and in front of contact face 46. In this position, there is substantially no tendency for the fastener 16 to open by accident. Longitudinal tension, such as pulling forces applied to the first and second strap runs, increase the force holding shut the fastener. The slight incline of contact faces 46 tends to direct the locking ring toward base 40. In addition, to any extent the tension causes contact between the lock ring 34 and tongue 50, lever arm 48 is urged downward still more tightly, preventing inadvertent release of the locking ring.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

I claim:

1. An improved weapon sling of the type having a butt end and an opposite stock end for, in use, attachment to the respective butt and stock of an elongate weapon, wherein said sling is comprised of at least first and second longitudinally extending strap portions, said first strap portion has a first end near the stock end of the sling and extends between said first end and the butt end of the sling, and said second strap portion extends between the butt end of the sling and the stock end of the sling, wherein the improvement comprises:

a fastening means carried by the second strap portion near the stock end of the sling for selectively engaging and disengaging said first end of the first strap portion, including both a camming member and a mounting means for pivotally carrying said camming member; and an engaging means carried by the first end of the first strap portion for engaging with and disengaging from the fastening means;

wherein the camming member includes first and second arms joined at an inside angle less than 180°, pivotally carried on the mounting means for selective movement between an open position, in which said first arm is between the engaging means and the first strap portion and the second arm is between the engaging means and the stock end of the sling, and a closed position in which the engaging means is between the first arm and the first strap portion and the second arm is between the engaging means and the butt end of the sling.

2. The sling of claim 1, wherein said fastening means further comprises a base overlying a face of said second strap portion and carrying said mounting means.

3. The sling of claim 2, further comprising:

a continuing segment of strap carried at the stock end of the second strap portion, folded back toward the butt end of the sling, overlying the stock end of the second strap portion, and together with the stock end of the second strap portion defining a terminal loop for, in use, attachment to a swivel mount; and wherein said base lies between and is secured to said continuing segment and the second strap portion.

4. The sling of claim 3, wherein:

the base has generally planar upper and lower faces;

said lower face of the base overlies the second strap portion;

the continuing strap segment overlies a part of the upper face of the base at the stock end of the base; and the mounting means is carried on the upper face of the base near the butt end of the base.

5. The sling of claim 4, wherein the mounting means comprises two spaced apart hinge mounts defining an inclusive outside width similar to an outside width of said second strap portion.

6. The sling of claim 5, wherein said engaging means comprises a lock ring of sufficient length and width to receive said hinge mounts.

7. The sling of claim 6, wherein said lock ring has a substantially straight edge across its stock end.

8. The sling of claim 7, wherein said hinge mounts have a contact surface on their stock end, upstanding with respect to the base and inclined toward the base by an inside angle slightly less than a right angle.

9. The sling of claim 8, wherein said inside angle is about 75°.

10. The sling of claim 2, wherein:

said mounting means pivotally engages the camming member on a pivot axis at a predetermined distance from said base;

said second arm is of a length, measured from the pivot axis, less than said predetermined distance of the pivot axis from the base; and said first arm is of a length greater than the second arm.

11. The sling of claim 10, wherein said engaging means comprises a lock ring of predetermined thickness; and said second arm is shorter than the predetermined distance of the pivot axis from the base by less than the predetermined thickness of the engaging means.

12. The sling of claim 2, further comprising:

a slide ring carried by said first strap portion; and a hinge means joining said slide ring to said engaging means for maintaining said first end of the first strap portion approximately aligned with said base when the engaging means is engaged with said fastening means.

13. The sling of claim 12, wherein:

said engaging means is a rectangular lock ring;

said slide ring is rectangular; and said hinge means comprises a tubular member receiving a straight side of each of said lock ring and slide ring.

14. The sling of claim 1, wherein the first and second arms of the camming member are joined at an acute inside angle.

15. The sling of claim 10, wherein the first and second arms of the camming member are joined at an inside angle of about 75°.

16. The sling of claim 1, wherein said first and second strap portions comprise a single, continuous strap, defining a loop at the butt end of the sling.

17. The sling of claim 16, further comprising a butt mounting swivel carried on the sling by said loop at the butt end thereof.

18. The sling of claim 1, further comprising:

a three bar friction slide mounted on said first strap portion for sliding motion along a length thereof;

a third strap portion having one end jointed to a center bar of said three bar friction slide and extending therefrom toward the stock end of the sling and joined to said first end of the first strap portion.

19. The sling of claim 18, wherein said first and third strap portions comprise a single, continuous strap, defining a length adjusting loop at the first end of the first strap.

20. The sling of claim 19, wherein said engaging means comprises a rectangular ring carried on the sling by said length adjusting loop.

* * * * *